US007598832B2

(12) United States Patent
Rival et al.

(10) Patent No.: US 7,598,832 B2
(45) Date of Patent: Oct. 6, 2009

(54) CONTACT PAD DESIGNED FOR A MOVABLE ELECTRICAL CONTACT OF A CIRCUIT BREAKER, MOVABLE ELECTRICAL CONTACT HAVING SUCH A PAD AND CIRCUIT BREAKER COMPRISING SUCH A CONTACT

(75) Inventors: Marc Rival, Saint Ismier (FR); Guy Gastaldin, Voreppe (FR); Jean Paul Favre Tissot, Brignoud (FR); Franck Pizot, Saint Egreve (FR)

(73) Assignee: Schneider Elecric Industries SAS, Rueil Malmaison (FR)

( * ) Notice: Subject to any disclaimer, the term of this patent is extended or adjusted under 35 U.S.C. 154(b) by 704 days.

(21) Appl. No.: 11/262,984

(22) Filed: Nov. 1, 2005

(65) Prior Publication Data

US 2006/0096846 A1 May 11, 2006

(30) Foreign Application Priority Data

Nov. 8, 2004 (FR) ..... 04 11869

(51) Int. Cl.
*H01H 1/00* (2006.01)
*H01H 1/02* (2006.01)

(52) U.S. Cl. ..... 335/196; 200/262; 200/265; 200/266

(58) Field of Classification Search ..... 335/196; 200/262, 265, 266

See application file for complete search history.

(56) References Cited

U.S. PATENT DOCUMENTS

| | | | |
|---|---|---|---|
| 4,689,196 | A | 8/1987 | Leung |
| 4,699,763 | A | 10/1987 | Sinharoy et al. |
| 5,199,553 | A | 4/1993 | Shinohara et al. |
| 5,445,895 | A | 8/1995 | Behrens et al. |
| 6,348,666 | B2 | 2/2002 | Rival et al. |

FOREIGN PATENT DOCUMENTS

| | | |
|---|---|---|
| DE | 41 11 683 | 10/1992 |
| EP | 1 711 339 A1 | 12/1986 |
| EP | 0 729 162 A1 | 8/1996 |
| EP | 1 711 339 B1 | 11/1998 |
| EP | 0729 162 B1 | 7/1999 |
| EP | 1 115 132 | 7/2001 |
| EP | 1 251 533 | 10/2002 |
| FR | 2 115 865 A2 | 7/1972 |

*Primary Examiner*—Ramon M Barrera
(74) *Attorney, Agent, or Firm*—Steptoe & Johnson LLP

(57) ABSTRACT

Contact pad designed to be fixed on a movable contact of a low-voltage circuit breaker designed to withstand peak short-circuit currents comprised between 200 and 600 amperes per square millimeter of pad. The pad is made of a silver- or copper-based conducting material alloy, a fraction of refractory particles such as tungsten carbide, tungsten or titanium nitride and a fraction of carbon fibers. The weight percentage of carbon fibers in the pad is strictly less than 2% of the total weight of the pad.

7 Claims, 1 Drawing Sheet

CONTACT PAD DESIGNED FOR A MOVABLE ELECTRICAL CONTACT OF A CIRCUIT BREAKER, MOVABLE ELECTRICAL CONTACT HAVING SUCH A PAD AND CIRCUIT BREAKER COMPRISING SUCH A CONTACT

BACKGROUND OF THE INVENTION

The invention relates to a contact pad designed to be fixed onto a movable contact of a low-voltage circuit breaker designed to withstand peak short-circuit currents comprised between 200 and 600 amperes per square millimetre of pad. The pad is formed by an alloy of silver-based or copper-based conducting material, a fraction of refractory particles such as tungsten carbide, tungsten or titanium nitride, and a fraction of carbon fibres.

STATE OF THE ART

The presence of electrical faults inside switchgear devices such as electrical circuit breakers causes opening of their electrical contacts at high speed. This high-speed opening is generally accompanied by electric arcs giving rise to large stresses at the level of said contacts, more particularly at the level of their contact surfaces or zones.

To increase the lifespan of electrical contacts used in such devices, it is known to modify the structure of the contact surface or zone of the electrical contacts. Solutions consist in adding composite materials in the form of pads of different thicknesses and of different materials at the level of the contact surface or zone.

The pads are generally made of silver or copper alloy. They are manufactured in the usual way by sintering a powder composed of a silver-based alloy, in particular silver and tungsten or silver and nickel. These contact materials present a high electrical conductibility, a sufficient oxidation resistance and good properties as far as contact resistance is concerned.

However, known silver-based contact materials show an undesirable tendency to welding. Moreover, they tend to cause adherence of the contact surfaces and/or migration of material between the contact elements. Finally, their use is generally associated with excessive wear of the contacts.

Numerous solutions consist in adding a conducting material such as graphite to the alloy powder. Such materials are commonly used to achieve circuit breaker contact pads. The graphite present in the metallic matrix enables the risk of welding of the contacts to be reduced. However, the presence of the graphite results in an increased mechanical erosion of the pad.

Carbon, in the form of fibres, can also be added to the alloy powder (document U.S. Pat. No. 4,699,763). The erosion resistance is then improved, but this improvement is acquired at the price of an impairment of the behaviour of the contact to welding. The carbon fibres are mixed with the metallic powder with an addition of a wetting, lubricating and solvent agent by wet channel, after which drying, compression and sintering are performed. The drawback of such a method is that it implies complications inherent to a process performed in wet channel.

To find an acceptable compromise between the erosion behaviour of the material and its anti-welding behaviour, it is proposed according to the document DE4,111,683 to mix graphite particles with carbon fibres, this mixture being incorporated in the metallic powder. This hybrid addition of carbon in the metallic matrix enables intermediate erosion and welding behaviours of the material to be obtained between those it would have shown with an addition of graphite particles only or with an addition of carbon fibres only. But it happens that, under high stresses and in particular under strong short-circuit currents, the graphite particles, on account of their perfect crystalline structure, show a tendency to be expelled from the surface of the material. This expulsion damages the surface of the material in such a way that the carbon fibres are in turn expelled therefrom. This results in an enrichment of the surface in silver and therefore in an impairment of the qualities initially sought for by adding the graphite.

In the document EP0171339 there is described a method for manufacturing electrical contacts by impregnation of a carbon fibre substrate by a liquid metal under pressure, followed by hot extrusion of the mixture thus obtained. It is observed that the resulting contacts show a too great propensity to welding.

In the document EP0,729,162, a method is described for manufacturing electrical contacts from a base of powder of a good electrical conducting metal such as silver and crushed carbon fibres with a mean length of less than 20 μm. In commonplace current breaking applications, it is noted that the contact surface, after breaking under a short-circuit current, keeps its fine, homogeneous and isotropic structure of fibre residues of variable length and any orientation in the silver matrix. The weight proportions of crushed carbon fibre are comprised between 2 to 5% with the silver powder. For limiting circuit breakers used for applications in which the arc stagnates little on the contacts, the material thus obtained shows a low contact resistance after breaking, good anti-welding qualities and an acceptable erosion resistance. However, use of this material meets its limits in applications involving selective circuit breakers where the fault current appearing on the pads has the value of the prospective short-circuit current, i.e. several tens of kilo-amperes. The erosion resistance of the contact pads described above is not sufficient and micro-weldings are observed when a current of several tens of kilo-amperes flows for 1 second without the switchgear apparatus opening.

Moreover, when the size of this type of circuit breaker is miniaturized and when addition of filtering elements drastically reduces the external manifestations, the optimum choice of contact material is even more drastic. Indeed, the breaking energy similar to that given off in conventional circuit breakers has to be absorbed in a miniaturized and almost closed volume. This results in a large deposit of pollutants on the contacts. This deposit is formed in particular by molten steel originating from ablation of the arc chute fins.

OBJECT OF THE INVENTION

The object of the invention is therefore to remedy the shortcomings of the state of the art so as to propose a contact pad having a low post-breaking contact resistance, a high erosion resistance and good anti-welding properties.

A contact pad according to the invention comprises a weight percentage of carbon fibres in the pad strictly less than 2% of the total weight of said contact pad.

The weight percentage of carbon fibres in the contact pad is comprised between 0.5% and 1.9% of the total weight of said contact pad.

Advantageously, the carbon fibres are crushed fibres with a length of less than 20 μm.

Preferably, the carbon fibres are formed by carbonized fibres containing at least 90% of carbon, less than 10% of nitrogen, substantially 1% of oxygen and less than 1% of hydrogen.

According to one embodiment of the invention, the contact pad is composed of 79% of silver alloy, 20% of tungsten carbide (CW) and 1% of carbon fibre.

A movable circuit breaker contact according to an embodiment of the invention comprises a movable contact finger connected to a contact pad as defined above, the pad being connected to the movable contact finger by means of a thin layer of silver alloy-based conducting material.

A circuit breaker according to an embodiment of the invention comprises an arc chute comprising filtering means designed to attenuate external manifestations of the gases present in the arc chute when openings occur, and comprises an opening mechanism acting on at least one movable contact as defined above and placed facing a stationary contact, said contacts being placed in the arc chute.

BRIEF DESCRIPTION OF THE FIGURES

Other advantages and features will become more clearly apparent from the following description of a particular embodiment of the invention, given as a non-restrictive example only and represented in the accompanying drawing in which.

DETAILED DESCRIPTION OF AN EMBODIMENT

Figure 1:
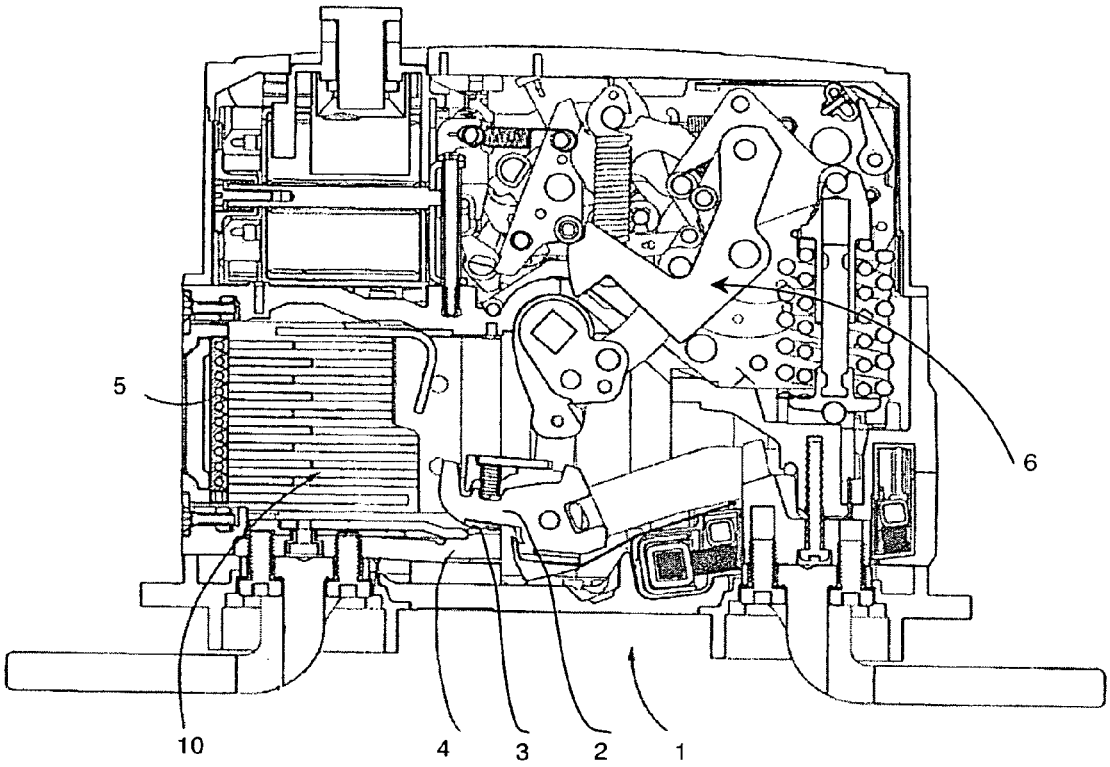
FIG. 1 represents a cross-sectional view of a circuit breaker comprising a movable contact having a contact pad according to an embodiment of the invention.

According to the preferred embodiment of the invention, the contact pad 3 is designed to be fixed on a movable contact 2 of a low-voltage circuit breaker 1 designed to withstand short-circuit currents of several kilo-amperes. Expressing the electrical current density in amperes per pad surface unit, a contact pad 3 according to the invention is designed to withstand peak short-circuit currents comprised between 200 and 600 amperes per square millimetre of pad.

The effects generated by the flow of these high short-circuit currents are felt even more strongly when the breaking energy is absorbed in an arc chute 10 having a miniaturized and almost closed or tightly sealed internal volume.

The contact pad 3 is composed of a conducting material such as silver (Ag) or copper (Cu) in which a fraction of carbon fibres and a fraction of refractory particles such as tungsten carbide (WC), tungsten (W), or titanium nitride (TiN) for example, is inserted. These refractory particles have a mean diameter of 1 to 10 microns.

The carbon fibres are formed by carbonized fibres containing at least 90% of carbon, less than 10% of nitrogen, substantially 1% of oxygen and less than 1% of hydrogen.

In the embodiment presented, carbon fibres with a mean length L1 comprised between about 100 μm and 800 μm and with a diameter comprised between 4 and 20 μm are chosen. These fibres undergo cold and dry mechanical treatment in mechanical crushing mill. The crushing intensity and duration conditions enable fibres to be obtained with a length that is statistically distributed around a mean value much lower than the initial mean value. Residues of crushed fibres having a mean length of less than 20 μm are thus obtained from the initial fibres. The crushed fibres are then added to the conducting material containing the refractory fractions. Mixing of the conducting material powder with the crushed carbon fibres is performed by dry channel in a mechanical mixer until a homogeneous mixture is obtained. Said mixture then undergoes unitary compression and sintering so as to obtain an isotropic material structure.

Such a manufacturing process is described in detail in the document EP-B-0,729,162, the description whereof is on these points incorporated here by reference.

In order to resist the specific stresses observed in selective circuit breakers able to withstand currents under the conditions described above, the erosion resistance of the pad thus obtained has to be increased. To do this, the weight percentage of carbon fibres in the pad is strictly less than 2%. It is preferably comprised between 0.5% and 1.9% of the total weight of the pad.

In un example of application of the invention, an ideal compromise in the choice of the proportions of the materials for this type of application consists in using a pad comprising 79% of silver (Ag), 20% of tungsten carbide (CW) and 1% of crushed carbon fibres.

Finally, this material with a suitable homogeneous structure presents a low and stable post-breaking contact resistance and a good erosion resistance under a short-circuit of several tens of kilo-amperes. In addition, this material develops anti-welding characteristics with respect to the steel balls present in the environment when breaking takes place in particular in the electrical arc column. An explosive phenomenon due to the degradation of the carbon fibre explains the anti-adhesion characteristics of this material with respect to molten steel balls.

A movable contact 2 of a circuit breaker 1 comprising a movable contact finger moving with respect to a stationary contact 4 of the circuit breaker has a contact pad 3 as defined above. Said contact pad is connected to the movable contact finger by means of a thin layer of conducting material the base whereof is silver or a mixture of copper and silver. This intermediate layer enables propagation of the cracks in the interface zone between the contact pad 3 and the finger to be blocked.

A circuit breaker 1 comprises an opening mechanism 6 acting on at least one electrical movable contact 2 as defined above. Said at least one movable contact 2 is placed facing a stationary contact 4. Said stationary contact is made of an alloy generally comprising a silver metallic matrix where a fraction of graphite powder particles is inserted. Said fraction of particles constitutes 3 to 5% of the weight of the alloy. The alloy can also comprise a certain quantity of refractory elements (W, WC, Ni) comprised between 2 and 30% of the total weight. The circuit breaker 1 according to a particular embodiment is designed to accept rated currents of 1,600 amperes and currents of short duration of 42,000 amperes for one second. The arc chutes 10 comprise, per pole, five movable contacts 2 associated with a strip of stationary contacts 4. Filtering means 5 placed on the walls of the arc chutes 10 are designed to strongly attenuate external manifestations of the gases present in said arc chutes when opening of the contacts takes place. As a non-restrictive example, the filtering means 5 comprise filters having specific technical characteristics as described in the patents filed by the applicant (EP-A-1,115,132, EP-A-1,251,533).

The invention claimed is:

1. A contact pad for being fixed onto a movable contact of a low-voltage circuit breaker, the contact pad designed to withstand peak short-circuit currents comprised between 200 and 600 amperes per square millimeter of pad, and comprising:

an alloy of silver- or copper-based conducting material, refractory particles, and carbon fibres, the carbon fibres being crushed fibres with a mean length of less than 20 μm, and the carbon fibres being formed by carbonized fibres containing at least 90% carbon, less than 10% nitrogen, 1% oxygen, and less than 1% hydrogen;

wherein the weight percentage of carbon fibres in the contact pad is less than 2% of the total weight of said contact pad.

2. Contact pad according to claim 1 wherein the weight percentage of carbon fibres in the contact pad is between 0.5% and 1.9% of the total weight of said contact pad.

3. A contact pad according to claim 2 comprising 79% silver, 20% tungsten carbide (CW) and 1% carbon fibre.

4. Contact pad according to claim 1, comprising 79% silver, 20% tungsten carbide (CW) and 1% carbon fibre.

5. A movable contact of a circuit breaker comprising a movable contact finger, wherein a contact pad according to claim 1 is connected to the movable contact finger by means of thin layer of conducting material having a base comprising silver or a mixture of copper and silver.

6. A circuit breaker comprising an opening mechanism and an arc chute, the arc chute comprising filtering means for attenuating external manifestations of gases present in the arc chute when the opening mechanism is in an open position, the opening mechanism acting on at least one movable contact, wherein said movable contact is a contact according to claim 5 facing a stationary contact, said movable and stationary contacts are in the arc chute.

7. A contact pad according to claim 1, wherein the refractory particles comprise one of tungsten carbide or titanium nitride.

* * * * *